United States Patent [19]

Suzuki

[11] 4,454,399

[45] Jun. 12, 1984

[54] CHANGE-OVER POSITION DISPLAY DEVICE FOR USE IN A SWITCH

[75] Inventor: Masaru Suzuki, Chiryu, Japan

[73] Assignee: Kabushiki Kaisha Tokai Rika Denki Seisakusho, Aichi, Japan

[21] Appl. No.: 437,864

[22] Filed: Oct. 29, 1982

[30] Foreign Application Priority Data

Nov. 17, 1981 [JP] Japan ..... 56-171164

[51] Int. Cl.[3] ..... H01H 9/16

[52] U.S. Cl. ..... 200/314; 200/DIG. 47; 200/313

[58] Field of Search ..... 200/310, 311, 312, 313, 200/314, DIG. 47, 308, 315

[56] References Cited

U.S. PATENT DOCUMENTS 3,769,482 10/1973 New et al. ..... 200/308
3,780,248 12/1973 Martin ..... 200/314
3,855,959 12/1974 Hinze ..... 200/308
3,855,961 12/1974 Schadow ..... 200/308
3,895,204 7/1975 Lewis ..... 200/314

FOREIGN PATENT DOCUMENTS 2231966 1/1974 Fed. Rep. of Germany ..... 200/308

*Primary Examiner*—John W. Shepperd
*Attorney, Agent, or Firm*—Jackson, Jones & Price

[57] ABSTRACT

A change-over position display device for use in a switch having a switch casing in which a movable contact is displaced to at least two positions through a pushing operation or a pulling operation of an operation knob. The device includes a plurality of change-over position display portions provided on the operating knob, an illuminating light source and a movable light guide for introducing illuminating light from the illuminating light source to any one of the plurality of the change-over position display portions in response to the pushing operation or the pulling operation of the operating knob.

10 Claims, 4 Drawing Figures

CHANGE-OVER POSITION DISPLAY DEVICE FOR USE IN A SWITCH

BACKGROUND OF THE INVENTION

The present invention generally relates to a switch in which a movable contact is displaced to at least two positions in a switch casing through a pushing operation or a pulling operation of an operating knob so as to open or close, or change over contacts of the switch. The present invention relates more particularly, to a change-over position display device for use in the switch, in which a plurality of change-over position display portions are provided on the operating knob. A movable light guide for introducing illuminating light from an illuminating light source to any one of the plurality of the change-over position display portions in response to the pushing operation or the pulling operation of the operating knob is provided between the plurality of the change-over position display portions and an illuminating light source such that the any one of the plurality of the change-over position display portions is selectively illuminated by the illuminating light source through the movable light guide in association with any one of positions for opening and closing the switch. The illuminating light source being provided in the switch casing.

Conventionally, in switches in which opening and closing or change-over of contacts thereof is controlled by pulling or pushing the operating knob, it has been a general practice that change-over position display portions are provided on the operating knob. However, the known switches have an inconvenience in that it is difficult to determine which one of the change-over positions is occupied by the switch in the case where the slide switch is provided in a dark location.

SUMMARY OF THE INVENTION

Accordingly, an essential object of the present invention is to provide an improved change-over position display device for use in a switch, in which, through a pushing operation or a pulling operation of an operating knob, contacts of the slide switch are opened or closed, or changed over and, at the same time, only one of the change-over display portions corresponding to the pushing operation or the pulling operation of the operating knob is selectively illuminated so as to clearly display the operating state of the switch, with substantial elimination of the disadvantages inherent in conventional change over position display devices of this kind.

Another important object of the present invention is to provide an improved change-over device of the above described type which is simple in structure, highly reliable in actual use, suitable for mass production at low cost, and can be readily incorporated into slide switches and the like at low cost.

In accomplishing these and other objects according to one preferred embodiment of the present invention, there is provided an improved change-over position display device for use in a switch having a switch casing in which a movable contact is displaced to at least two positions through a pushing operation or a pulling operation of an operating knob, said change-over position display device comprising:

a plurality of change-over position display portions which are provided on said operating knob;

an illuminating light source which is provided in said switch casing; and a movable light guide for introducing illuminating light from said illuminating light source to any one of the plurality of said change-over position display portions in response to the pushing operation or the pulling operation of said operating knob, said light guide is provided between the plurality of said change-over position display portions and said illuminating light source;

whereby any one of the plurality of said change-over position display portions can be selectively illuminated by said illuminating light source through said movable light guide in association with any one of said positions for opening and closing said switch.

In accordance with the present invention, since any one of the plurality of the change-over position display portions is selectively illuminated, it becomes possible to determine which one of the change-over positions is occupied by the switch even at a dark spot.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
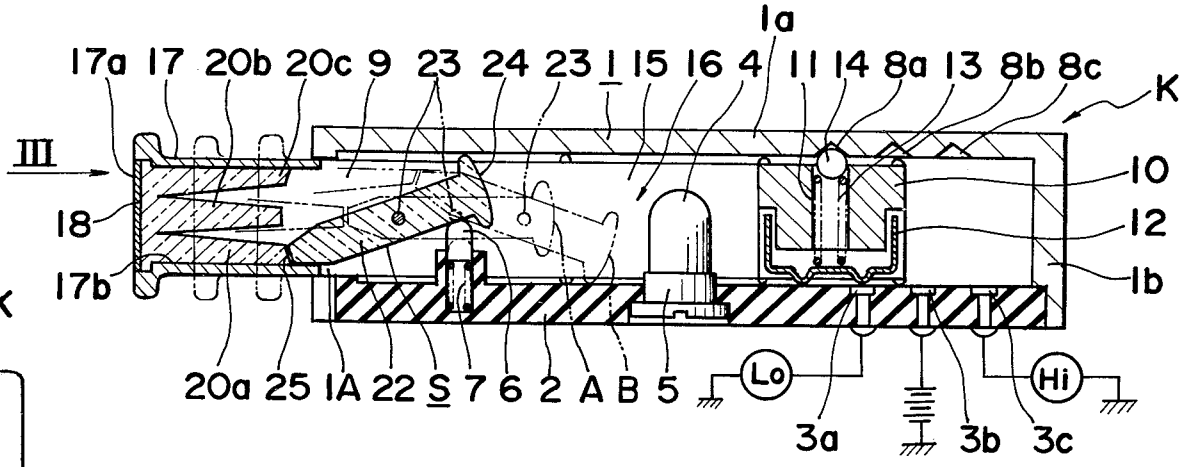
FIG. 1 is a vertical cross-sectional view of a switch in which a change-over position display device according to one preferred embodiment of the present invention is incorporated.
Figure 2:
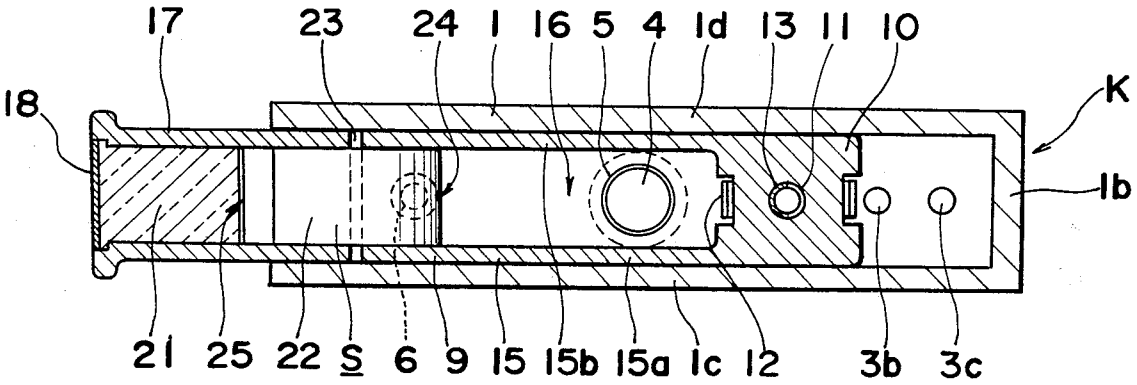
FIG. 2 is a horizontal cross-sectional view of the switch of FIG. 1.
Figure 3:
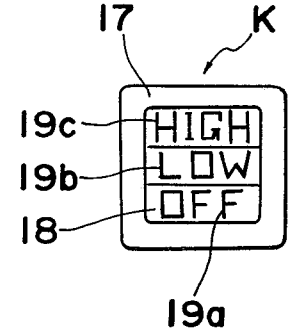
FIG. 3 is a view as observed in the direction of the arrow III in FIG. 1.

Referring now to the drawings, there is shown in FIGS. 1 and 2, a switch K in which a change-over position display device S according to one preferred embodiment of the present invention is incorporated. The switch K includes an elongated switch casing 1 having a rectangular cross section with an insulator 2 being attached to a lower surface of the switch casing 1. It is to be noted here that all directional indications such as "lower", "front", "rear", etc. relate to the illustration in FIG. 3, hereinbelow.

More specifically, the switch casing 1 includes an upper wall 1*a*, a rear wall 1*b*, a right wall 1*c*, a left wall 1*d* and the insulator 2 attached to the lower surface of the switch casing 1 and therefor, is formed into an elongated box-like configuration having a front opening 1A of a rectangular shape. Three fixed contacts 3*a*, 3*b* and 3*c* are provided in the insulator 2 and adjacent to the rear wall 1*b*. The fixed contacts 3*a*, 3*b* and 3*c* are disposed centrally between the right wall 1*c* and the left wall 1*d* and in line with each other in a longitudinal direction of the switch K so as to be spaced a predetermined pitch therebetween, respectively with the fixed contact 3*c* being disposed more adjacent to the rear wall 1*b* than the fixed contact 3*b*. A socket 5 for a lamp 4 acting as an illuminating light source is provided in the insulator 2 and forwardly of the fixed contact 3*a* so as to be disposed in line with the fixed contact 3*a* and substantially centrally of the switch K in the longitudinal direction thereof. A contact piece 6, which is urged or biased by a spring 7 to project into the switch K, is provided in the insulator 2 and forwardly of the socket 5 so as to be disposed in line with the socket 5 and adjacent to the front opening 1A. Namely, the contact piece 6, socket 5 and fixed contacts 3*a*, 3*b* and 3*c* are provided in the insulator 2 in this sequence in the longitudinal direction of the switch K so as to be disposed in line with each other in the longitudinal direction of the switch K and centrally between the right wall 1*c* and the left wall 1*d* with the contact piece 6 being more adjacent to the front opening 1A. Furthermore, engageable grooves 8*a*, 8*b* and 8*c* are formed on an inner face of the upper wall 1*a* so as to be disposed at positions corresponding to the fixed contacts 3*a*, 3*b* and 3*c*, respectively.

A sliding member 9 is fitted into the front opening 1A so as to be slidable in the longitudinal direction thereof and includes an operating knob 17, a right wall 15*a* and a left wall 15*b*. The operating knob 17 is formed at a front end of the sliding member 9 so as to project out of the front opening 1A. A contact holder 10 is integrally formed with or attached to a rear end of the sliding member 9 so as to form a hollow portion 16 enclosed by the operating knob 17, the right wall 15*a*, the left wall 15*b* and the contact holder 10, and has a through-hole 11 extending vertically at a central portion thereof. The lamp 4 and the contact piece 6 are provided so as to project into the hollow portion 16 from the insulator 2. A compression spring 13 is fitted into the through-hole 11. Furthermore, an engageable ball 14 and a movable contact 12 adapted to be selectively brought into contact with the fixed contacts 3*a*, 3*b* and 3*c* are provided at an upper portion and a lower portion of the through-hole 11 such that the engageable ball 14 and the movable contact 12 are, respectively, urged vertically in opposite directions remote from each other by the compression spring 13, so that the engageable ball 14 and the movable contact 12 are, respectively, pressed onto the inner face of the upper wall 1*a* upwardly and an inner face of the insulator 2 downwardly. The engageable ball 14 is selectively brought into engagement with the engageable grooves 8*a*, 8*b* and 8*c* when the slide member 9 is slid in the longitudinal direction of the switch K. This arrangement permits the movable contact 12 to be, respectively, brought into contact with only the fixed contact 3*a*, with the fixed contacts 3*a* and 3*b*, and with the fixed contacts 3*b* and 3*c* when the engageable ball 14 is engaged with the engageable grooves 8*a*, 8*b* and 8*c*.

The operating knob 17 has a rectangular recess 17*a* formed at a front face thereof and a rectangular through-opening 17*b*. A light transmittable display panel 18 having change-over position display portions 19*a*, 19*b* and 19*c* provided thereon is fitted into the recess 17*a* so as to be flush with the front face of the operating knob 17. Furthermore, light transmittable lenses 20*a*, 20*b* and 20*c* are fitted into the through-opening 17*b* so as to be in contact with a rear face of the display panel 18 such that front ends of the lenses 20*a*, 20*b* and 20*c* are, respectively, disposed at positions corresponding to the change-over position display portions 19*a*, 19*b* and 19*c*. The lenses 20*a*, 20*b* and 20*c* are formed with rear ends having an arcuate shape as seen in FIG. 1, which are separated vertically from each other. A light leakage preventive film 21 such as a coating film, a plating film, etc. is formed on outer surfaces of the lenses 20*a*, 20*b* and 20*c* except for their rear end surfaces and front end surfaces.

Figure 4:
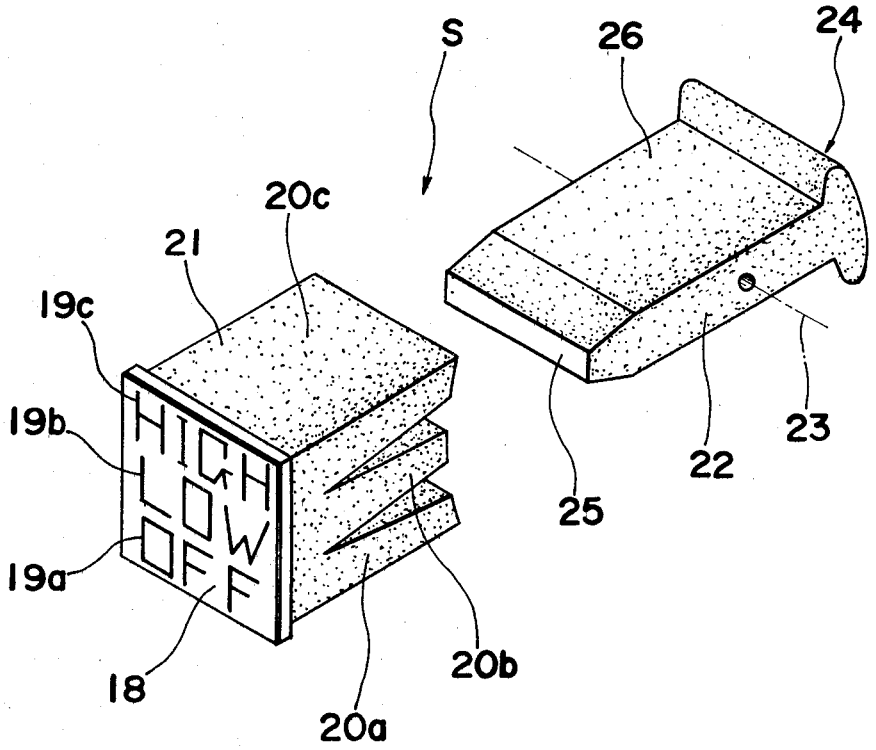
FIG. 4 is an exploded perspective view showing, on an enlarged scale, a portion of the change-over position display device of FIG. 1.

An elongated movable light guide 22 is pivotally supported by a rod 23 extending horizontally through the right wall 15*a* and left wall 15*b* so as to be pivoted about the rod 23 and between the lamp 4 and the change-over position display portions 19*a*, 19*b* and 19*c*. As best shown in FIG. 4, the movable light guide 22 is made of transparent synthetic resin and has a light incoming portion 24 and a light outgoing portion 25 which are, respectively, formed at a rear end and a front end thereof. A light leakage preventive film 26 is formed on an outer surface of the movable light guide 22 except for the light incoming portion 24 and the light outgoing portion 25. It is so arranged that the movable light guide 22 is pivoted such that the light outgoing portion 25 confronts the rear ends of the lenses 20*a*, 20*b* and 20*c*, selectively.

By the above described arrangement of the switch K, when the operating knob 17 is fully pulled out of the front opening 1A such that the engageable ball 14 is brought into engagement with the engageable groove 8*a* as shown in FIG. 1, the rod 23 is disposed forwardly of the contact piece 6, so that the contact piece 6 is urged by the spring 7 to project into the hollow portion 16 and pushes a rear portion of the movable light guide 22 upwardly and thus, the light outgoing portion 25 confronts the rear end of the light transmittable lens 20*a*, whereby the change-over position display portion 19*a* is illuminated.

When the operating knob 17 is pushed into the front opening IA such that the engageable ball 14 is brought into engagement with the engageable groove 8*b*, the rod 23 is disposed above the contact piece 6 as shown in imaginary lines indicated by A in FIG. 1, so that the movable light guide 22 is held horizontally and thus, the light outgoing portion 25 confronts the rear end of the light transmittable lens 20*b*, whereby the change-over position display portion 19*b* is illuminated.

When the operating knob 19 is further pushed into the front opening IA such that the engageable ball 14 is brought into engagement with the engageable groove 8*c*, the rod 23 is disposed rearwardly of the contact piece 6, so that the contact piece 6 is urged by the spring 7 to project into the hollow portion 16 so as to push a front portion of the movable light guide 22 upwardly and thus, the light outgoing portion 25 confronts the rear end of the light transmittable lens 20*c*, whereby the change-over position display portion 19*c* is illuminated.

It should be noted here that the switch K having the change-over position display device S of the present invention incorporated therein illustrates a dimmer switch for changing over a main head lamp "Hi" and an auxiliary head lamp "Lo" for motor vehicles. When the engageable ball 14 is brought into engagement with the engageable groove 8*a*, the change-over position display portion 19*a* bearing "OFF" therein is illuminated so as to turn off the main head lamp "Hi" and auxiliary head lamp "Lo". When the engageable ball 14 is brought into engagement with the engageable groove 8*b*, the change-over position display portion 19*b* bearing "LOW" thereon is illuminated so as to turn on the auxiliary head lamp "Lo". When the engageable ball 14 is brought into engagement with the engageable groove 8*c*, the change-over position display portion bearing "HIGH" thereon is illuminated so as to turn on the main head lamp "Hi".

As is clear from the foregoing, in accordance with the present invention, when the contacts are opened or closed or changed over through the pushing operation or the pulling operation of the operating knob, light from the illuminating light source is transmitted to any one of the plurality of the change-over position display portions provided on the operating knob by operating the movable light guide in response to the pushing operation or the pulling operation of the operating knob so as to selectively illuminate any one of the plurality of the change-over position display portions, with the movable light guide being provided between the illuminating light source and the plurality of the change-over position display portions in the switch. Accordingly, in accordance with the present invention, even if the plurality of the change-over position display portions are provided on the operating knob, it is possible to accurately indicate the operating states of the switch even in the case where the switch is provided at a dark spot.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. An electrical switch assembly for connection to an electrical circuit and capable of displaying its operative state comprising:

a casing member;

means for varying the electrical conducting state of the circuit connected to the switch assembly;

a display member operatively positioned at one end of the casing member and providing at least two visual display indications of the status of the switch assembly;

a light source;

a light guide for transmitting light pivotally mounted in the casing member and located between the light source and the display member, and means for physically displacing the light guide in coordination with the means for varying the electrical conducting state of the circuit whereby the display member is illuminated by the light source to provide a visual display indication of the status of the switch assembly.

2. The invention of claim 1 wherein the means for varying the electrical conducting state includes an operating knob sliding member slidable into and out of the casing member.

3. The invention of claim 2 wherein the operating knob sliding member pivotally mounts the light guide.

4. The invention of claim 1 wherein the display member is a unitary member with furcated individual entrance lenses.

5. The invention of claim 1 further including a spring biased member relatively movable to the light guide and biasing the light guide whereby the position of contact of the spring biased member can determine the relative position of the light guide with the display member.

6. The invention of claim 1 wherein the display member includes entrance lenses having arcuate surfaces concentrically arranged about the pivot point of the light guide.

7. An electrical switch assembly for connection to an electrical circuit and capable of displaying its operative state comprising:

a casing member having a longitudinal axis;

a movable sliding member mounted to the casing member, and displacable along the direction of the longitudinal axis;

means for varying the electrical conducting state of the circuit connected to the switch assembly;

a display member operatively positioned at one end of the casing member and providing at least two visual display indications of the status of the switch assembly;

a light source;

a light guide for transmitting light, pivotally mounted, and located between the light source and the display member, and a contact member contacting the light guide and capable of displacing it about its pivot point, one of the contact member and the light guide mounted for movement with the sliding member while the other is mounted to be relatively stationary with the casing member whereby movement of the sliding member, in coordination with the means for varying the electrical conducting state of the circuit, will cause the light guide to illuminate a visual display indication of the display member for displaying its current operative state.

8. The invention of claim 7 wherein the light guide is pivotally mounted on the sliding member.

9. The invention of claim 8 wherein the display member is a unitary member with furcated individual entrance lenses.

10. A changeover position display device for use in a switch having a switch casing in which a movable contact is displaced to at least two positions through a pushing operation or a pulling operation of an operating knob, said changeover position display device comprising:

a plurality of changeover position display portions which are provided on said operating knob;

an illuminating light source which is provided in said switch casing;

a movable light guide for introducing illuminating light from said illuminating light source to any one of the plurality of said changeover position display portions in response to the pushing operation or the pulling operation of said operating knob, said light guide is provided between the plurality of said changeover position display portions and said illuminating light source;

a pivotal shaft provided in a direction in which the illuminating light is introduced to any one of the plurality of said changeover position display portions by said movable light guide, and a contact piece which is urged by a spring to bias a side face of said movable light guide whereby any one of the plurality of said change-over position display portions can be selectively illuminated by said illuminating light source through said movable light guide when said pivotal shaft is displaced to any one of said positions disposed forwardly of and rearwardly of said contact piece in response to a pulling operation or a pushing operation of said operating knob so as to pivot said movable light guide such that the any one of the plurality of said changeover position display portions is selectively illuminated.

* * * * *